US005179892A

United States Patent [19]

Cicatello et al.

[11] Patent Number: 5,179,892

[45] Date of Patent: Jan. 19, 1993

[54] STRAP FEED ASSEMBLY WITH FLOATING BACK-UP WHEELS

[75] Inventors: Samuel Cicatello, East Amherst; Robert M. Macartney, Lockport, both of N.Y.

[73] Assignee: General Motors Corporation, Detroit, Mich.

[21] Appl. No.: 670,625

[22] Filed: Mar. 18, 1991

[51] Int. Cl.[5] ..... B65B 13/22

[52] U.S. Cl. ..... 100/32; 226/183; 226/187

[58] Field of Search ..... 100/8, 26, 29, 32, 33 PB, 100/31; 226/183, 186, 187, 193

[56] References Cited

U.S. PATENT DOCUMENTS

| | | | |
|---|---|---|---|
| 1,513,574 | 10/1924 | Barber | 226/183 X |
| 1,981,411 | 11/1934 | Fritz . | |
| 2,523,387 | 9/1950 | Natzke | 226/187 X |
| 2,776,605 | 1/1957 | McAfoos | 226/183 X |
| 2,858,130 | 10/1958 | Bauer et al. . | |
| 2,978,161 | 4/1961 | Debrie | 226/183 |
| 3,269,300 | 8/1966 | Billett et al. | 100/8 |
| 3,442,203 | 5/1969 | Kobiella | 100/26 |
| 3,566,778 | 3/1971 | Vilcins | 100/32 X |
| 3,752,058 | 8/1973 | Lems | 100/32 |
| 3,777,964 | 12/1973 | Kruner et al. . | |
| 3,794,233 | 2/1974 | Dykmans | 226/183 |
| 3,889,584 | 6/1975 | Wiklund | 100/31 X |
| 3,985,277 | 10/1976 | Wright . | |
| 4,212,238 | 7/1980 | Simmons et al. | 100/32 |
| 4,244,773 | 1/1981 | Siebeck et al. | 100/33 PB X |
| 4,252,157 | 2/1981 | Ohnishi | 100/31 X |
| 4,624,400 | 11/1986 | Zimmer . | |

FOREIGN PATENT DOCUMENTS

| | | | |
|---|---|---|---|
| 3525647 | 1/1987 | Fed. Rep. of Germany | 100/32 |
| 587704 | 1/1959 | Italy | 100/32 |
| 1013349 | 4/1983 | U.S.S.R. | 100/8 |

*Primary Examiner*—Harvey C. Hornsby
*Assistant Examiner*—Stephen F. Gerrity
*Attorney, Agent, or Firm*—Ronald L. Phillips

[57] ABSTRACT

A strap feed assembly has a drive wheel driven by a reversible electric motor to feed and tension a strap around an item and wherein a back-up wheel assembly imposes a tension force on the strap by use of multiple floating wheels which are arranged to spring bias and float with respect to a strap and apply a tension force thereto across an extended strap area to reduce pressure on the strap so as to prevent it from being bent or deformed whereby a consistent strap feed is maintained.

3 Claims, 3 Drawing Sheets

STRAP FEED ASSEMBLY WITH FLOATING BACK-UP WHEELS

FIELD OF THE INVENTION

This invention relates to strap feed assemblies which include a knurled drive wheel to feed a strap through a guide track about an item to be banded and more particularly to such strap feed assemblies having an idler wheel to apply a force on the strap during a strap tension cycle of operation.

BACKGROUND OF THE INVENTION

Current production strap feed assemblies include a drive wheel and idler wheels that are operated during a four cycle banding process. The cycles include a feed cycle wherein an electric drive motor is driven in a first direction to feed a strap through a track and around the item to be banded. The drive motor rotates a knurled drive wheel with respect to an idler wheel assembly that cooperates with the drive wheel to apply a minimal drive force during the feed cycle. The drive motor is controlled to rotate in an opposite direction during a tension cycle wherein the strap is pulled in a direction opposite to the feed direction outwardly of the track and around the item to cause the strap to tighten the strap around the item to be banded.

During the tension cycle a greater force is applied on the strap by the idler wheel and drive wheel so as to keep the strap from slipping during the tension cycle. Once the tensioning is complete, leading and trailing strap portions are fastened together during a crimping cycle to create a sealed connection around the item to be banded. The strap is then severed during a cutting cycle to separate a sealed strap loop from the trailing portion of the strap material.

Current strap feed assemblies include those shown in U.S. Pat. Nos. 3,566,778 and 3,442,203 in which a two wheel assembly provides a minimal force in the strap feed direction and a greater force on the strap during reverse drive in which the strap is tensioned. In such arrangements, a pull-back force produced during the tension cycle is limited to approximately 80 pounds of force before the strap begins to slip. While suitable for certain applications, the upper force limit is not adequate when the items are made up of material or components which must be compressed during the tension cycle such as heat exchangers with tube bundles.

Other strap feed assemblies include a hydraulic cylinder to move the drive head to perform the tensioning step. Initially, the feed wheels are reversed to pull back on the strap to take up most of the slack in the strap. A hydraulic cylinder is then moved and serrated edges thereon grip the strap and pull it further to set a desired tension level under the control of a pressure sensor and regulator that will control the pressure in the hydraulic cylinder to properly tension the strap.

In each case, the strap feed assemblies of the prior art can deform the trailing end of the strap through guide tracks for banding the item.

SUMMARY OF THE INVENTION

A feature of the present invention is to provide a simplified, all mechanical bandhead arrangement for a strap feed assembly in which several back-up wheels are supported on a carriage by independent, floating spring suspensions which spread the spacing of the back-up wheels to increase the area of force application for a given number of wheels so as to direct a tensioning force on the strap which will tighten the strap around items which will tend to compress during a tension cycle and wherein the tension force will be uniformly distributed across the strap at a pressure level which will prevent deformation of the strap material.

Yet another feature of the present invention is to prevent deformation of a strap during a tension cycle of a strap feed assembly for wrapping a flexible strap around an item which can be compressible; the strap feed assembly including a drive wheel connected to a reversible electrical drive motor for feeding and reversing the strap to wrap the strap around an item and to tension the strap once it is wrapped around the item and including a back-up wheel assembly to tension the strap during a reverse drive in which the feed wheel has a peripheral surface including a knurled portion for defining a contact surface between the strap and the feed wheel during feeding an wrapping of the strap around the item to be banded; and wherein a back-up wheel assembly is included to provide a drive force on the strap of a magnitude to tension the strap during a tension cycle of operation; the back-up wheel assembly including a plurality of back-up wheels each supported on an independent floating spring suspension for spreading the surface contact area on the strap so as to reduce the pressure imposed on the strap by the tension force thereby to prevent strap deformation for maintaining consistent strap feed.

A further feature of the present invention is to provide a strap feed assembly as set forth in the preceding paragraph characterized by the feed wheel and the back-up wheel having oppositely facing knurled surfaces in engagement with opposite sides of the strap.

A still further feature of the present invention is to provide such strap feed assemblies further characterized by the back-up wheel assembly including a plurality of spread wheels each having a flat surface portion with knurling formed completely circumferentially therearound having a width substantially corresponding to the width of the knurling on the feed wheel.

Yet another feature of the present invention is to provide such strap feed assemblies further characterized by the back-up wheel assembly including two pairs of spread wheels; a wheel arm for each of the wheels in the two pairs of wheels; each of the wheel arms having one end pivotally connected at a point intermediate each of the pairs of wheels; each of the wheel arms having a second end located adjacent the feed wheel and a pin for rotatably supporting a back-up wheel thereon; and a spring located intermediate ends of each of the wheel arms for imposing a spring force on the spread wheels which define an increased area across more than 90 degrees of the circumference of said feed wheel thereby to reduce pressure on the strap for preventing deformation of the strap for more consistent feed thereof with respect to the item being banded.

Further objects and advantages of the present invention will be apparent from the following description, reference being had to the accompanying drawings wherein an embodiment of the present invention is clearly shown.

DETAILED DESCRIPTION OF A PREFERRED EMBODIMENT OF THE INVENTION

Figure 1:
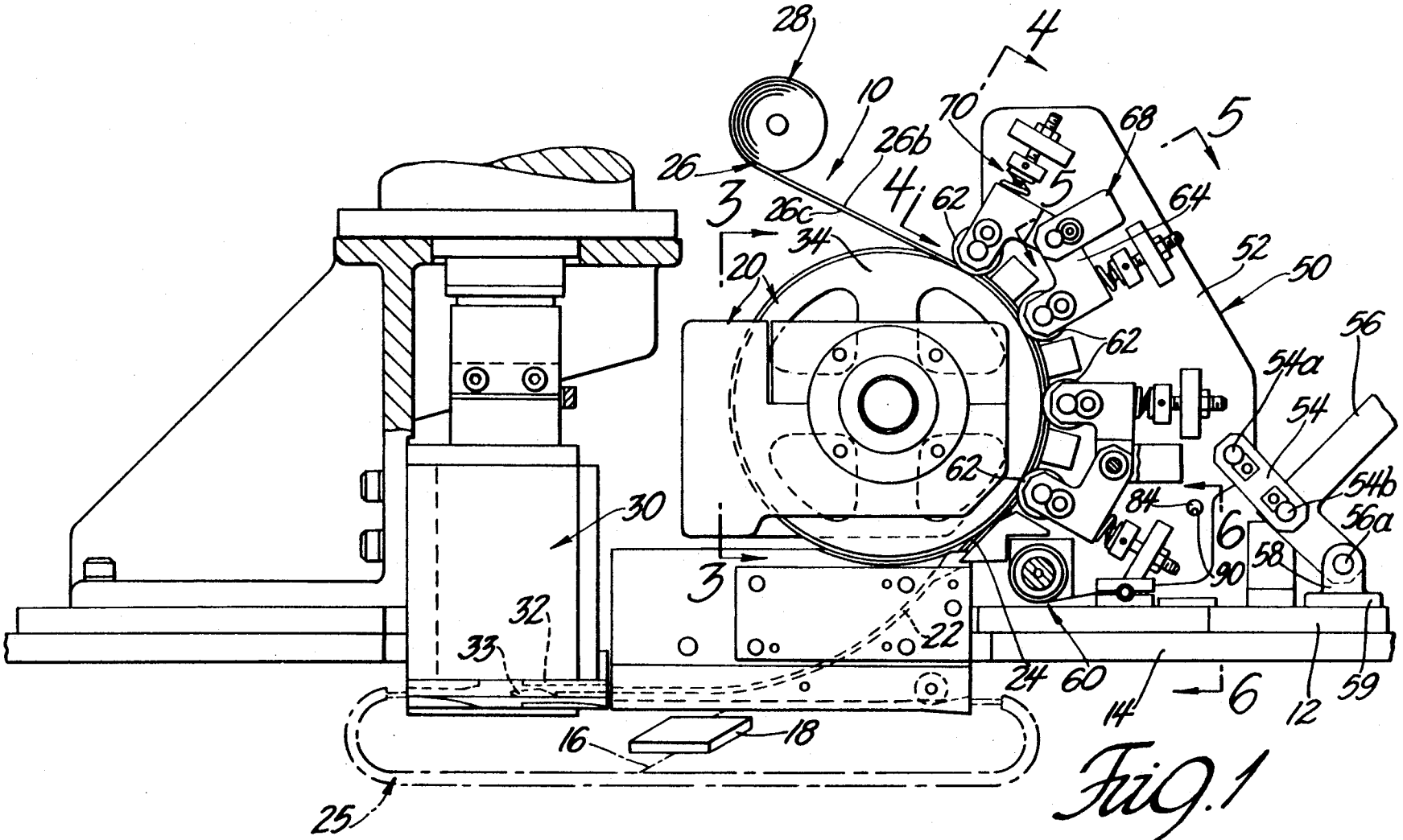
FIG. 1 is a front elevational view of a strap feed assembly including the present invention.
Figure 2:
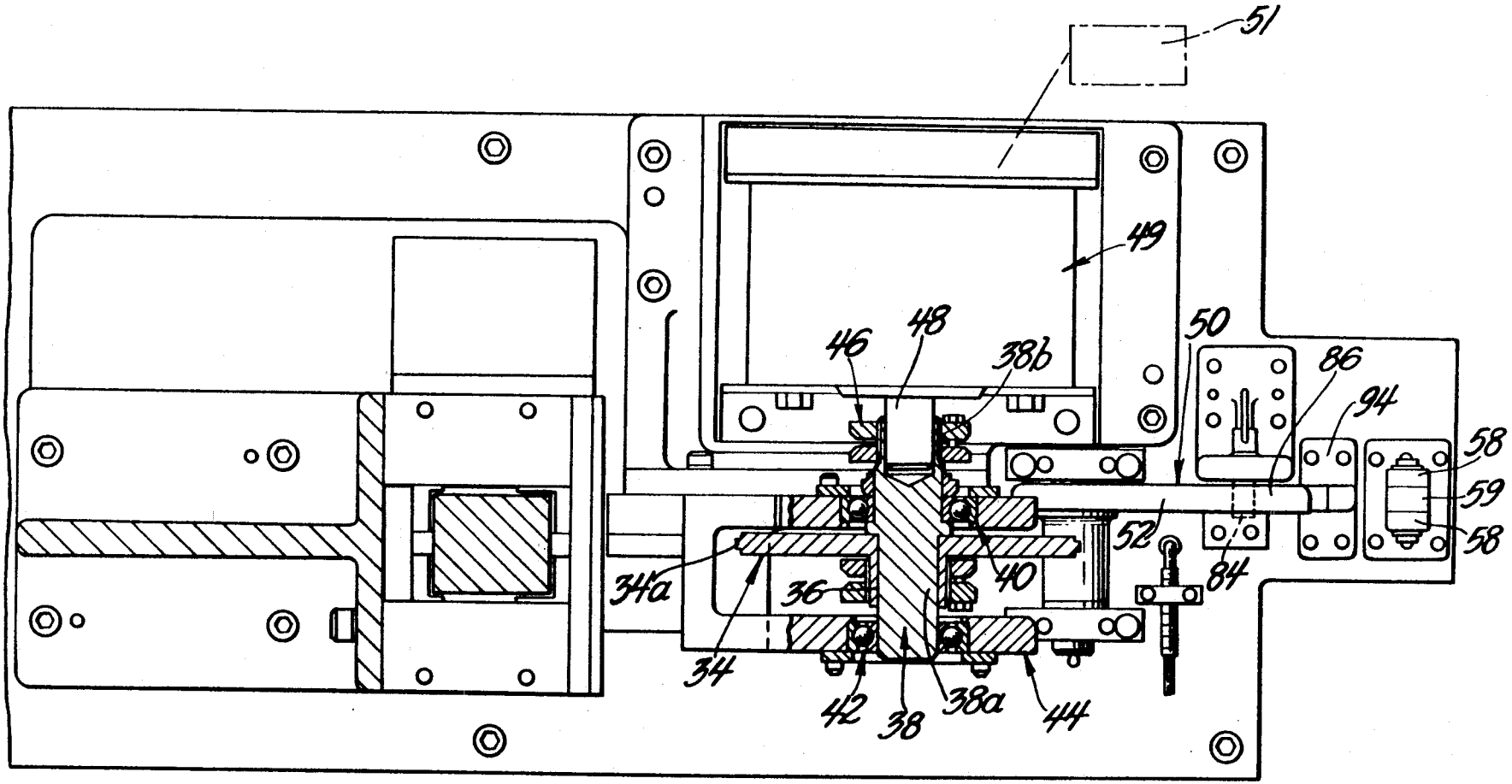
FIG. 2 is a top elevational view of the assembly in FIG. 1.
Figure 3:
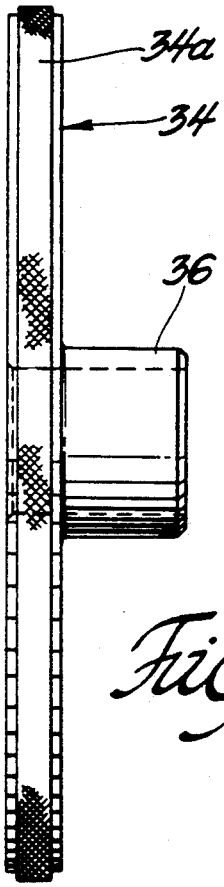
FIG. 3 is a side view of a drive wheel in the assembly of FIG. 1.

Referring now to FIG. 1, a strap feed assembly 10 is illustrated having a base plate 12 adapted to be mounted on a platform 14 for straddling a conveyor line 16 on which are located items 18 which are to be wrapped and banded by the assembly 10.

The strap feed assembly 10 includes a feed head 20 with a guide track 22 through which the leading end 24 of a strap 26 can be fed from a roll 28 of strap material. The leading end 24 is guided from the track 22 through a clamp head 30 to be looped about the items diagrammatically shown in FIG. 1. During the feed cycle, the leading end 24 is directed from the guide track 22, through a loop guide 25, thence through a track 32 within the clamping head 30 where it is gripped by fingers 33 more specifically set forth in U.S. Pat. No. 5,129,210 which is assigned to an assignee common to the assignee of this application.

In accordance with the present invention, the assembly 10 includes a drive wheel 34 having a hub 36 connected to the outboard end 38*a* of a shaft 38 supported at opposite ends by bearing assemblies 40, 42 located in spaced legs of a bearing support 44. The inboard end 38*b* of shaft 38 is connected by a clamp coupling 46 to the output shaft 48 of a reversible electric drive motor 49. The drive motor 49 is under the control of a controller 51 of the type more specifically set forth in U.S. Pat. No. 5,146,847, also assigned to an assignee common to that in the present application.

The present invention is directed to a force generating floating back-up wheel assembly 50 which is configured to distribute the force of the back-up wheel assembly to reduce pressure loads on the strap during a tension cycle.

More particularly, to accomplish this objective, the drive wheel 34 includes a knurled peripheral surface 34*a*. The back-up wheel assembly 50 cooperates with the drive wheel 34 to apply a tension force against the strap 26 as it is wrapped around the item.

The back-up wheel assembly includes a retractable carriage plate 52 connected by a link 54 having pivot pins 54*a*, 54*b* at opposite ends thereof engaged with a peripheral edge of the plate 52 and the center pivot point of a crank arm 56 which has a lower pivot point thereof connected by a pivot pin 56*a* to spaced lugs 58 on a pivot plate 59 connected to the baseplate 12. The opposite lower end of the carriage plate 52 is supported by a bearing assembly 60 for limited pivotal movement with respect to the baseplate 12.

The back-up wheel assembly 50 further includes four independent floating spring suspensions 70 for locating back-up wheels 62 so as to attenuate tension forces on the strap 26 by spreading the area of strap on which the force is applied. As a consequence, the pressure on the strap is lowered such that the strap remains undeformed for consistent feed. At the same time, a tension force is maintained which is capable of compressing the item 18 during a tension cycle wherein the drive motor 40 is conditioned by the controller 42 to be rotated in a counter clockwise direction as viewed in FIG. 1. During this cycle, as more specifically described in U.S. Pat. No. 5,129,210 the leading end 24 is held in the clamp head 30 at a track 32 thereof, all as more specifically set forth in the co-pending applications.

Figure 5:
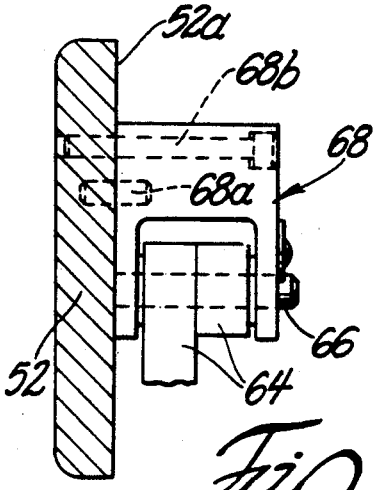
FIG. 5 is an enlarged sectional view taken along the line 5—5 of FIG. 1 looking in the direction of the arrows.
Figure 6:
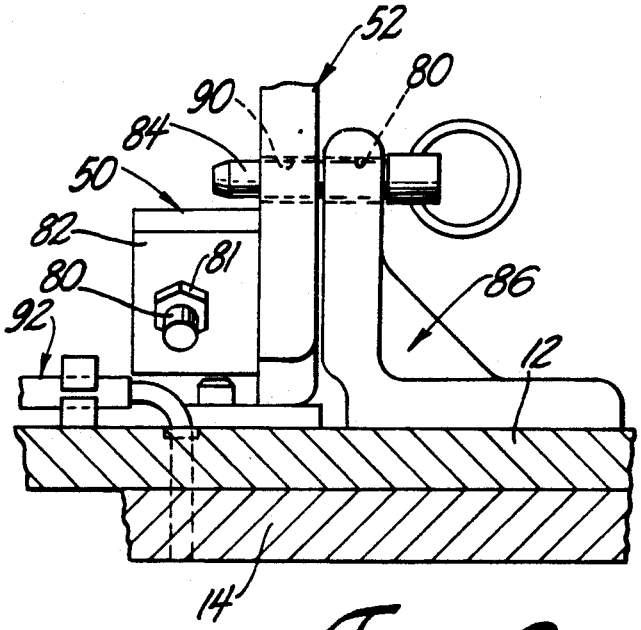
FIG. 6 is an enlarged sectional view taken along the line 6—6 of FIG. 5 looking in the direction of the arrows.

During such a tensioning cycle, the separate floating spring suspensions 70 support multiple back-up wheels 62 so as to apply a tension force that is spread through more than 90 degrees on the periphery of the drive wheel 30. Specifically, each of the floating suspensions includes a wheel support arm 64 which is pivotally supported on a pivot pin 66 located midway of a bifurcated bracket 68 located on the front face 52*a* of the carriage plate 52 by a dowel pin 68*a* and secured thereto by a screw 68*b* as shown in FIG. 5.

Figure 4:
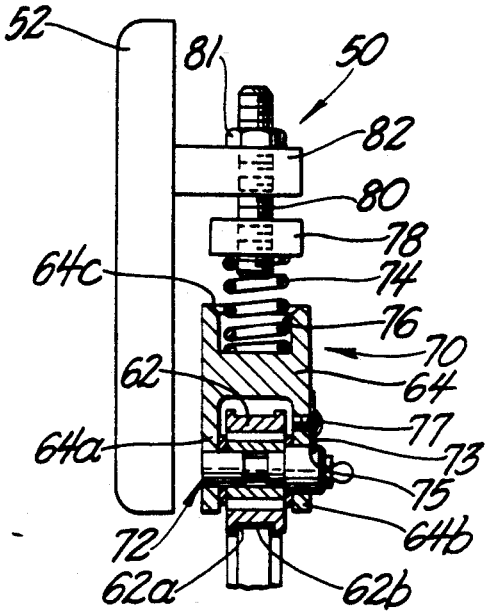
FIG. 4 is an enlarged view taken from the line 4—4 of FIG. 1 showing an independent floating spring suspension partially sectioned and partially in elevation.

Each of the bifurcated brackets 68 supports a pair of the support arms 64, each extending in an opposite direction from the pin to spread the location of each back-up wheel 62 on the floating suspensions 70. Each back-up wheel 62 is supported on a spindle 72 directed through spaced walls 64*a*, 64*b* of the support arm 64 as best shown in FIG. 4. Each of the spindles 72 is held in place by a lock tab 73 held in place with a lock groove 75 in the outer end of the spindle by a screw 77.

Each of the back-up wheels 62 includes an annular groove 62*a* therein in which is located the knurled surface 34*a* of the drive wheel 30. The surface 62*b* of each of the grooves is knurled so that the strap 26 will have its opposite surfaces 26*b*, 26*c* engaged by a friction surface. The tensioning force generated by the surface 62*b* and the knurled surface of the drive wheel 30 is proportional to the force of a spring 74, one of which is located radially outwardly of each of the floating back-up wheels 62. Each of the springs 74 has one end located in a pocket 76 formed in the upper end 64*c* of the support arm 64. The opposite end of each of the springs 7 is engaged by an adjustment member 78 threadably received on the end of a threaded member 80 having the upper end thereof engaged by a lock screw 81 seated on the upper end of a support member 82 secured to the carriage plate 52 and extending outwardly thereof.

The back-up wheel assembly 50 is held in its strap engagement position by a lock pin 84 directed through an anchor plate 86 secured to base 12. The lock pin 84 is directed through aligned holes 88, 90, respectively, formed in anchor plate 86 and carriage plate 52.

Additionally, a photo eye sensor 92 is provided on the base 12 in front of the anchor plate 52. The photo eye sensor 92 "senses" the strap to ensure it has been fed around the track. A guide brace 94 is provided between the anchor plate 86 and the pivot plate 59 to support the carriage plate 52 in its release position in which a strap 26 can be cleared from between the drive wheel 34 and the back-up wheels 62.

The adjustment member 78 is threaded relative to support member 82 to set the amount of spring force applied to the respective back-up wheels 62 for varying the amount of tension force applied to the strap loop during the tension step. The spring force is resolved into a pressure multiplied by the surface area of contact between the strap surfaces 26*b*, 26*c* and the multiple back-up wheels 62 (four in number). The spread wheel configuration increases the surface area so that the tension force can be maintained at a greater level without increasing pressure unduly on the strap to cause it to be deformed to a degree which will adversely effect its feed through the various aforedescribed guide tracks.

The reason for increasing the surface area in contact with the strap surfaces 26*b*, 26*c* is that strap deformation can make it extremely difficult to feed the strap through a track system viz. tracks 22 and 32 with any degree of consistency. Increased contact area obviates the need for increasing the pressure exerted on the strap by the backing wheels 62 thereby preventing deformation in accordance with the invention.

With such an increase in surface area, the tension force is maintained without excessive pressure acting on the strap and it will be appreciated that the result is a more consistent feed of a strap into separate loops without requiring machine down time to clear strap segments that have been deformed by the feed mechanism. Furthermore, while the embodiment disclosed is presently preferred that other embodiments will occur to those skilled in the art from the above teaching including application to strap feed assemblies which include a different tracking and clamp head arrangement.

The embodiments of the invention in which an exclusive property or privilege is claimed are defined as follows. What is claimed is:

1. A strap feed assembly for wrapping a flexible strap around an item including a drive wheel connected to a reversible drive motor for feeding and reversing the strap to wrap the strap around an item and to tension the strap once it is wrapped around the item, the improvement comprising:

said drive wheel having a peripheral surface including a knurled surface for defining a contact surface between the strap and the drive wheel during feeding and wrapping of the strap around the item;

force generating means operatively connected to said drive wheel to provide a drive force on said strap of a magnitude sufficient to both feed and tension the strap during reversal of the drive motor between a feed mode and a tension mode of operation;

said force generating means including means for attenuating the force imposed on the strap during the tension mode thereby to reduce pressure on the strap for preventing strap deformation so as to maintain consistent feed of the strap around the item to be wrapped; and a plurality of back-up wheels spread through more than 90 degrees of said drive wheel, each of said back-up wheels including a surface portion with knurling formed completely circumferentially therearound having a width substantially corresponding to the width of the knurling on said drive wheel, said means for attenuating including a separate biasing means connected to each of said plurality of back-up wheels for independently biasing said back-up wheels radially against said drive wheel.

2. A strap feed assembly for wrapping a flexible strap around an item including a drive wheel connected to a reversible drive motor for feeding and reversing the strap to wrap the strap around an item and to tension the strap once it is wrapped around the item, the improvement comprising:

said drive wheel having a peripheral surface including a knurled surface for defining a contact surface between the strap and the drive wheel during feeding and wrapping of the strap around the item;

force generating means operatively connected to said drive wheel to provide a drive force on said strap of a magnitude sufficient to both feed and tension the strap during reversal of the drive motor between a feed mode and a tension mode of operation;

said force generating means including means for attenuating the force imposed on the strap during the tension mode thereby to reduce pressure on the strap for preventing strap deformation so as to maintain consistent feed of the strap around the item to be wrapped; and two pairs of back-up wheels; a wheel arm for each of the back-up wheels in each of said two pair of back-up wheels; each of said wheel arms having one end pivotally connected together at a point intermediate each of said pairs of back-up wheels; each of said wheel arms having a second end located adjacent said drive wheel and a spindle for rotatably supporting said back-up wheels; and means intermediate said first and second ends of said wheel arms for imposing a spring force on each of said pairs of back-up wheels; said back-up wheels attenuating the force of said springs across greater than 90 degrees of the circumference of said drive wheel thereby to prevent deformation of said strap as it is fed around said item.

3. A strap feed assembly for wrapping a flexible strap around an item including a drive wheel connected to a reversible drive motor for feeding and reversing the strap to wrap the strap around an item and to tension the strap once it is wrapped around the item, the improvement comprising:

said drive wheel having a peripheral surface for defining a contact surface between the strap and the drive wheel during feeding and wrapping of the strap around the item;

force generating means operatively connected to said drive wheel to provide a drive force on said strap of a magnitude sufficient to both feed and tension the strap during reversal of the drive motor between a feed mode and a tension mode of operation;

said force generating means including means for attenuating the force imposed on the strap during the tension mode thereby to reduce pressure on the strap for preventing strap deformation so as to maintain consistent feed of the strap around the item to be wrapped; and said force generating means including a plurality of back-up wheels spaced about said drive wheel peripheral surface for feeding the strap between said peripheral surface and said back-up wheels;

said drive wheel and said back-up wheels having oppositely facing knurled surfaces in engagement with opposite sides of the strap feed therethrough, and a separate biasing means connected to each of said plurality of back-up wheels for independently biasing each of said back-up wheels radially toward and against said drive wheel.

* * * * *